US007699685B1

(12) United States Patent
Gerstner

(10) Patent No.: US 7,699,685 B1
(45) Date of Patent: Apr. 20, 2010

(54) METHOD AND APPARATUS FOR GRINDING A WORKPIECE

(75) Inventor: Daniel Thomas Gerstner, Gastonia, NC (US)

(73) Assignee: Huffman Corporation, Clover, SC (US)

( * ) Notice: Subject to any disclaimer, the term of this patent is extended or adjusted under 35 U.S.C. 154(b) by 0 days.

(21) Appl. No.: 12/315,217

(22) Filed: Dec. 1, 2008

Related U.S. Application Data

(62) Division of application No. 11/890,950, filed on Aug. 8, 2007, now Pat. No. 7,473,160.

(60) Provisional application No. 60/836,518, filed on Aug. 9, 2006.

(51) Int. Cl.
*B24B 49/00* (2006.01)

(52) U.S. Cl. ..... 451/7; 451/10; 451/11; 451/450

(58) Field of Classification Search ..... 451/7, 451/10, 11, 28, 53, 57, 58, 449, 450
See application file for complete search history.

(56) References Cited

U.S. PATENT DOCUMENTS

| | | | | |
|---|---|---|---|---|
| 3,747,284 | A | 7/1973 | Lyczko | 51/267 |
| 5,430,936 | A | 7/1995 | Yazdzik, Jr. et al. | 29/889.2 |
| 5,611,724 | A | 3/1997 | deGraaff | 451/53 |
| 7,316,600 | B1 | 1/2008 | Pilkington | 451/5 |
| 2003/0223831 | A1 | 12/2003 | Viens et al. | 408/60 |
| 2004/0154443 | A1 | 8/2004 | Zurecki et al. | 82/1.11 |

FOREIGN PATENT DOCUMENTS

| | | | |
|---|---|---|---|
| JP | 56148602 | A | 11/1981 |
| JP | 08257923 | A | 10/1996 |
| JP | 10109268 | A | 4/1998 |

OTHER PUBLICATIONS

Norton brochure, ALTOS® High Performance Ceramic Aluminum Oxide Grinding Wheels, Norton Company, One New Bond Street, Worcester, MA 01615-0008, Form #7591 Aug. 2000, 2 pages.

*Primary Examiner*—Eileen P. Morgan
(74) *Attorney, Agent, or Firm*—K&L Gates LLP

(57) ABSTRACT

A method and apparatus for_cutting a profile in a workpiece, such as a turbine disk, without cracking the parent material which includes providing a grinding wheel having a ceramic grinding surface formed with an optimized grain material and grain spacing to produce large chips that are easily removed from the workpiece, applying the grinding wheel to the workpiece at a predetermined material removal rate, and increasing the material removal rate when the burning point is recognized at the surface of the workpiece by the grinding action of the grinding wheel, and delivering coolant/lubricant to the workpiece during the grinding operation.

5 Claims, 5 Drawing Sheets

METHOD AND APPARATUS FOR GRINDING A WORKPIECE

CROSS-REFERENCE TO RELATED APPLICATION

This application is a divisional of and thus is entitled to the benefit of, and claims priority to U.S. patent application Ser. No. 11/890,950 filed Aug. 8, 2007, and entitled "Method and Apparatus for Grinding A Workpiece," which claims priority of provisional U.S. Patent Application Ser. No. 60/836,518 filed on Aug. 9, 2006, and entitled "Method And Apparatus For Grinding A Workpiece," the disclosures of which are incorporated herein by reference as if set forth fully herein.

BACKGROUND OF THE PRESENT INVENTION

This invention relates generally to an apparatus and method for grinding a workpiece, and more particularly to the grinding of the base portion of turbine and compressor disks or rotors (which are hereafter collectively referred to as "turbine disks") and related types of workpieces.

The base or root portions of turbine blades are generally formed with a series of shoulders which are closely fitted into profiles of the corresponding support portions of the turbine disks to make sure that the turbine blades are maintained securely in place during rotation of the disks.

Heretofore, the desired configuration of the profiles in the turbine disk have typically been formed using conventional broaching machines which form the profiles without cracking the parent material. Broaching machines, in general, include a cutter, and it consists of cutting teeth arranged in a row. The broaching machine works on the principal of proper offsetting of the workpiece and then performing work on it.

As a result, broaching machines are very expensive, very heavy so as to require special foundations, and involve a significant amount of time to reset the cutting members for each new job. Also, the cutting teeth require frequent resharpening.

When the profiles in a turbine disk are formed using a broaching machine, it is usually done in three sequential steps which are illustrated in FIG. 1 of this application. The first cut is the roughing broach, after which there is a semi-finishing broach, and a finishing broach, all as illustrated in FIG. 1, which is intended to be a diagrammatic view of a typical cutting sequence for a broaching machine. In some operations, the roughing broach is not carried out as a separate step.

In general, although the broaching process for forming the profiles for the profiles in a turbine disk is relatively fast and efficient, it has a number of disadvantages. First, the purchase price, maintenance cost, floor space requirements and long lead-time to obtain broaching machines is a significant disadvantage. Additionally, the machines must be supported on a special concrete base with other infrastructure to support broaching machines, which adds to the overall cost of the machines. Finally, the cutting elements of the broaching machine must be resharpened frequently, and a significant amount of time is required to set up and change over broaching machines to cut profiles with different profiles.

It is also known, generally, that profiles may be formed in metals and alloys using conventional grinding wheels, such as, for example, a grinding wheel having a fused aluminum oxide grinding surface. The grinding wheel is applied to the workpiece in a direction perpendicular to its axis of rotation and perpendicular or at a specified angle to the surface of the workpiece to be ground. As the grinding wheel is applied to the workpiece, the workpiece is ground away by the abrasive surface of the grinding wheel, which also generally results in very small loose particles or grits of the grinding wheel surface being separated from the grinding wheel. The grinding action of the grinding wheel may generate sufficient heat to actually "burn" the workpiece to the point at which the microstructure and properties of the workpiece are altered that can create small cracks or other undesirable thermal damage in the workpiece. As used herein the terms "burn" and "burning" shall mean the point at which the thermal effects of the grinding operation create detrimental thermal damage or adverse conversion of the material property of the workpiece, such as, for example, cracks. The adverse affects of the cracks and other thermal damage being formed as a result of excess heat generation are known, and they are exacerbated when the workpiece is a turbine disk for aircraft which, in use, is exposed to a wide range of heating and cooling during take-offs and landings, and these temperature variations and mechanical loads can cause small cracks to become larger and larger to a point where the safety of the aircraft could be affected. In a effort to avoid or reduce the burning of the workpiece, it is common practice to recognize the point at which burning may begin to occur, and reverse the movement of the grinding wheel in a direction away from the workpiece and, in some cases, to increase the amount of cooling liquid applied to the workpiece at the point where the grinding wheel is being applied. Additionally, because of the grinding action applied to the workpiece by a conventional grinding wheel, the grinding wheel must make a large number of passes through the workpiece, and the passes are carried out at reduced material removal rates so as to reduce the risks of excess heat generation, all of which results in a grinding operation that is very slow, and there is still a significant risk of creating cracks and thermal damage in the workpiece.

Finally, grinding wheels that have an extruded SG ALOx crystal of known aspect ratio and a ceramic bond material with an open structure are known, but heretofore they have had only limited applications, such as turbine blade root forms and other roughing operations.

Accordingly, a need exists for properly forming profiles in a turbine disk or related workpiece using a method and apparatus that avoids many of the disadvantages of the currently used broaching machines and conventional grinding wheels, and particularly for forming the profiles without cracking the parent material, or inducing. other thermal damage thereto.

SUMMARY OF THE INVENTION

Briefly summarized, the present invention provides a method of cutting a profile in a workpiece without cracking the parent material which includes the steps of providing a grinding wheel having a ceramic grinding surface formed with an optimized grain material and grain spacing to produce large chips that are easily removed from the workpiece, applying the wheel to the workpiece at a predetermined material removal rate, increasing the material removal rate when the burning point is reached at the surface of the workpiece by the grinding action of the grinding wheel, and delivering a coolant/lubricant to the workpiece during the grinding operation.

Preferably, the grinding wheel is driven by a motor, and the torque applied to the wheel is increased when the burning point is reached at the surface of the workpiece by the grinding action of the grinding wheel. Also, the predetermined parameters of the coolant/lubricant are preferably monitored, and delivered to the point where the grinding surface of the wheel is applied to the workpiece, and the coolant/lubricant is also delivered directly to the surface of the grinding wheel.

The present invention also provides a method of cutting a profile in a turbine disk without cracking the parent material which includes the steps of providing a grinding wheel having a ceramic grinding surface formed of aluminum oxide that is sufficiently porous to cause chips of the turbine disk to be removed by the grinding wheel being applied to the turbine disk, applying the grinding surface of the wheel against the turbine disk at a predetermined material removal rate to form a profile therein, moving the grinding wheel into contact with the turbine disk at a material removal rate greater than the predetermined material removal rate when burning at the surface of the turbine disk results from the grinding action of the grinding wheel, and delivering a coolant/lubriant to the turbine disk during the grinding operation.

The drive motor may be operated to rotate the grinding wheel, and the material removal rate is increased when burning occurs at the surface of the turbine disk resulting from the grinding action of the grinding wheel. Additionally, the coolant/lubricant is preferably delivered to the turbine disk adjacent the point where the grinding wheel is being applied to the turbine disk, and the coolant is also delivered directly to the grinding surface of the grinding wheel.

The present invention also provides an apparatus for cutting profiles in a workpiece without cracking the parent material which includes a grinding wheel having a ceramic grinding surface formed with an optimized grain material and grain spacing to produce large chips that are easily removed from the workpiece, drive means for moving the grinding wheel into contact with the workpiece at a predetermined material removal rate and for rotating the grinding wheel by providing high torque at the low end of the speed range of the motor, and a coolant/lubricant delivery system for monitoring predetermined parameters of a coolant/lubricant and for delivering the coolant/lubricant to the workpiece at the point where the wheel is applied to the workpiece during the grinding operation. The monitored parameters may include the pressure, speed, and temperature of the coolant.

The drive means can be operated to move the grinding wheel into contact with the workpiece until the burning point is reached at the surface of the workpiece by the grinding action of the grinding wheel, and the drive means continues moving the grinding wheel into contact with the workpiece at an increased material removal rate when the burning point is reached at the surface of the workpiece as a result of the grinding action of the grinding wheel.

Preferably, the coolant/delivery delivery system includes a first section that provides conduits for directing coolant/lubricant at the point where the grinding wheel makes contact with the workpiece and a second section that provides conduits for directing coolant directly to the surface of the grinding wheel, and the first section of the coolant/lubricant delivery system applies a coolant/lubricant to the point of contact at a predetermined pressure, speed and temperature, and the first section of the coolant delivery system monitors the pressure, speed and/or temperature of the coolant/lubricant. Also, the first section of the coolant delivery system preferably generates a warning signal if the pressure, speed, or temperature of the coolant varies from predetermined values

DESCRIPTION OF THE PRESENT INVENTION

As best seen in the accompanying drawings, the present invention provides a method and apparatus for forming the profiles in a turbine disk or similar workpiece utilizing a unique grinding system.

Figure 3:
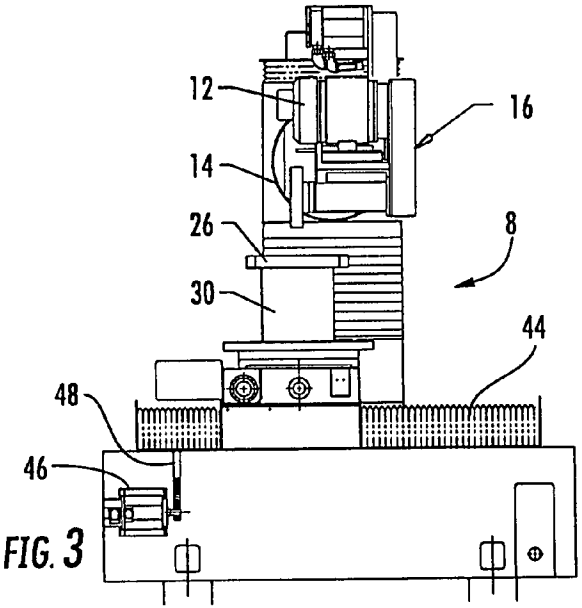
FIG. 3 is an end view of the apparatus illustrated in FIG. 2.
Figure 2:
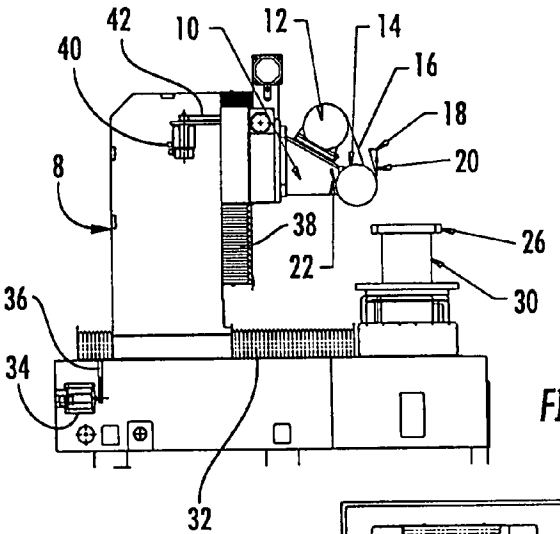
FIG. 2 is a side view of one embodiment of the apparatus of the present invention.
Figure 4:
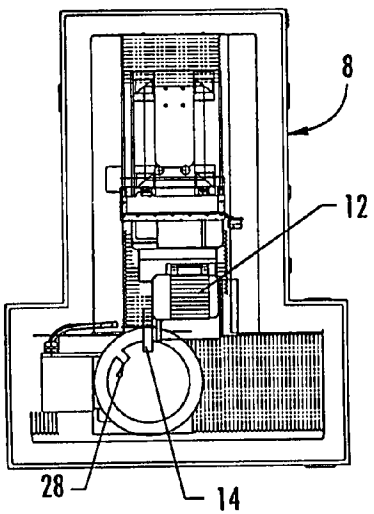
FIG. 4 is a top view of the apparatus illustrated in FIG. 2.

More specifically, as best seen in FIGS. 2-4, the grinding apparatus 8 of the present invention includes a support 10 on which is mounted a drive motor 12, and a grinding wheel 14 that is rotated by the drive motor 12 through a drive belt system 16 or other suitable drive means. The system also includes a plurality of coolant delivery nozzles which are diagrammatically illustrated in FIG. 5, including a primary nozzle 18, a corner nozzle 20, and a scrubber nozzle 22, all of which are constructed and arranged to provide a pressurized flow of coolant directly to the surface of the grinding wheel 14, with low aeration. Finally, a conventional computerized monitoring system 24 is provided for monitoring the flow of coolant through the nozzles 18-22, and the monitoring system 24 can also be used to monitor other relevant process parameters. The grinding wheel 14 is moved into engagement with a workpiece such as a turbine disk 26 by a plurality of drive arrangements. The support 10 for the grinding wheel 14 is moved in a horizontal direction by a conventional servo driven ballscrew drive assembly 32 that includes a motor 34 operating the assembly 32 through a belt drive 36, and the support 10 and grinding wheel 14 is moved in a vertical direction by a similar servo driven ballscrew drive assembly 38 that includes a motor 40 operating the assembly 38 through a belt drive 42. The workpiece 26 and the jig 30 are moved in a sideways direction by a conventional servo driven ballscrew drive 44 that includes a motor 46 operating through a belt drive 48.

It will be understood, of course, that the particular arrangement of the above-described elements in FIGS. 2-4 is merely representative of one grinding system that embodies the present invention, and there are many variations and additions that can be made to this basic system without departing from the scope of the invention.

The material removal rate at which material is ground away from the workpiece 26 is a primarily a function of (1) the speed at which the grinding wheel 14 is rotated; (2) the speed at which the grinding wheel 14 is moved into contact with the workpiece 26 by the movement of the support 10; and (3) the depth of the cut in the workpiece 26 during each pass of the grinding wheel 14. The drive motor 12 is selected to provide the required power and torque which maximizes the performance of the grinding wheel 14, and it provides high torque at the low end of the speed range of the drive motor 12 which allows the grinding wheel 14 to be moved into engagement with and to pass through the turbine disk 26 at high material removal rates using a minimum of power and significantly reducing adverse thermal effects. While it will be appreciated that the specifications of the drive motor 12 will vary depending on the application of the present invention, a typical drive motor 12 for grinding a profile in a turbine disk 26 would be a 40 horsepower motor that can operate at low speeds up to 3000 rpms while still maintaining a torque of between 50 and 70 lb/ft., such as an electric motor manufactured and sold by Reuland Electric Company under Product No. 0030M-1AAN-0020. The grinding wheel 14 is specially formed with a formulation that includes an open porous surface configuration designed to produce a large chip formation as material is being removed from the turbine disk workpiece 26, and that provides very high material removal rates using the grinding wheel.

In one preferred embodiment of the grinding wheel 14, the grinding wheel 14 is formed utilizing a high performance extruded ceramic aluminum oxide abrasive that has a controlled aspect ratio, a strong vitrified bond and porous/permeable structure, and which includes optimized grain spacing to produce the aforesaid large chips that can be easily removed from the turbine disk. One grinding wheel that provides these features is the ALTOS High Performance Ceramic Aluminum Oxide grind wheel manufacture by Norton company in Worcester, Mass., which an be operated within the range of 4000 to 6000 surface feet per minute in grinding profiles in a turbine disk However, it will be understood that other surface configurations for the grinding wheel 14 offering similar features may be used to obtain similar grinding results.

Figure 7A:
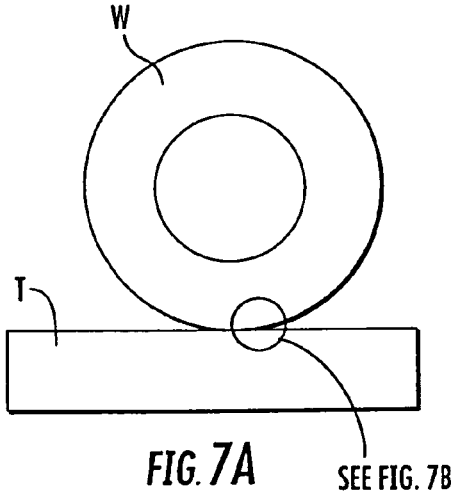
FIG. 7A (PRIOR ART)
FIGS. 7A and 7B are diagrammatic illustrations of the grinding action of a conventional grinding wheel.
Figure 8A:
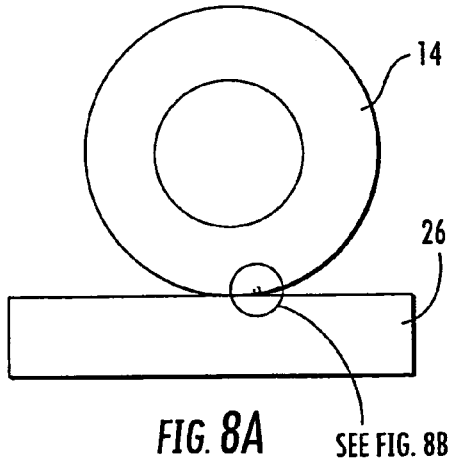
FIGS. 8A and 8B are diagrammatic illustrations of the grinding action of the grinding wheel of the preferred embodiment of the present invention.
Figure 7B:
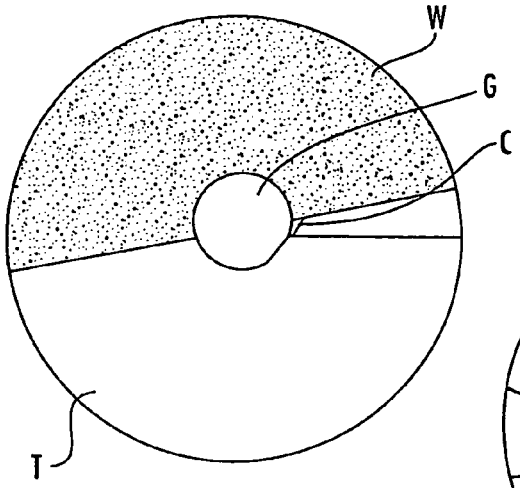
FIG. 7B (PRIOR ART)
Figure 8B:
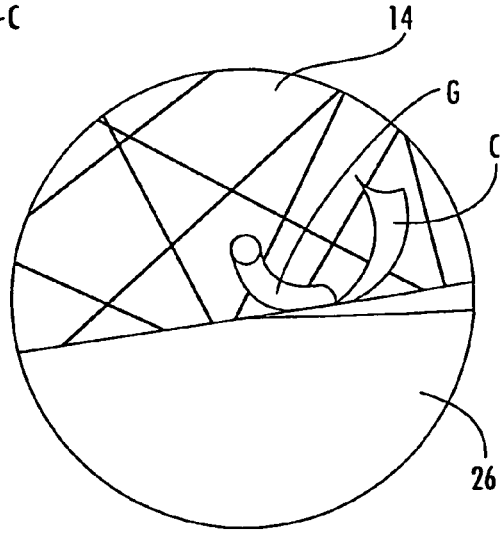

As best seen in the diagrammatic illustrations in FIGS. 7A and 7B, a conventional prior art grinding wheel W removes material from the workpiece T by the frictional contact between the surface of the grinding wheel W and the workpiece, which results in the separation from the grinding surface of minute particles of the grinding wheel and similar separation of minute particles of the workpiece. More specifically, looking at FIG. 7B, which is grossly exaggerated in scale for clarity of illustration, the grinding surface of the grinding wheel W includes a large number of densely formed "grits", one of which is illustrated in FIG. 7B as item G. This grit G, as it engages the workpiece W, can only remove a very small portion P of the workpiece W. This conventional grinding method generates a considerable amount of heat at the point where the grinding wheel contacts the workpiece, and with a corresponding high risk of burning the workpiece to the point where cracks occur as discussed above. Also, the density of the grit formation in a conventional grinding wheel W does not allow the coolant/lubricant to cycle through the grind zone, which results in the cooling and lubricating effect of the coolant/lubricant being limited at the point of the grind. By contrast the grinding wheel 14 utilized in the present invention, with the ceramic coating at the grinding surface as described above, chips away relatively large chips C of the workpiece as best seen in the diagrammatic illustrations in FIGS. 8 and 8A, which results in substantially reduced heat created at the point where the grinding wheel 14 contacts the turbine disk 26. More specifically, as best seen in FIG. 8B, which is also grossly exaggerated, the grinding surface of the grinding wheel 14 has an open porous grinding surface, and the grit G is larger and has an elongated extent which forms a much larger chip C because the open porous grinding surface of the grinding wheel 14 permits the chip C to 'grow" within the more open areas of the grinding surface. As a result, some of the heat created by the grinding action is transferred to the larger chip C instead of being transferred to the workpiece. Accordingly, by virtue of this difference between the grinding wheel 14 and conventional grinding wheels heretofore used for similar grinding operations, and by virtue of the unique combination of elements that make up the apparatus 8 of the present invention, it has been found that the depth of the cut in the workpiece 26 by the grinding wheel for each pass can be much deeper than with such conventional grinding wheels.

Figure 5:
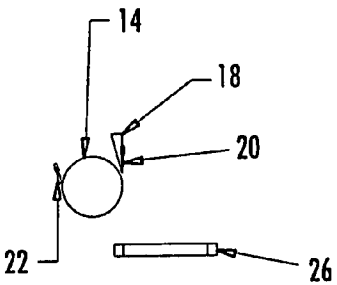
FIG. 5 is a detailed view illustrating the nozzle arrangement in the preferred embodiment of the present invention.
Figure 6:
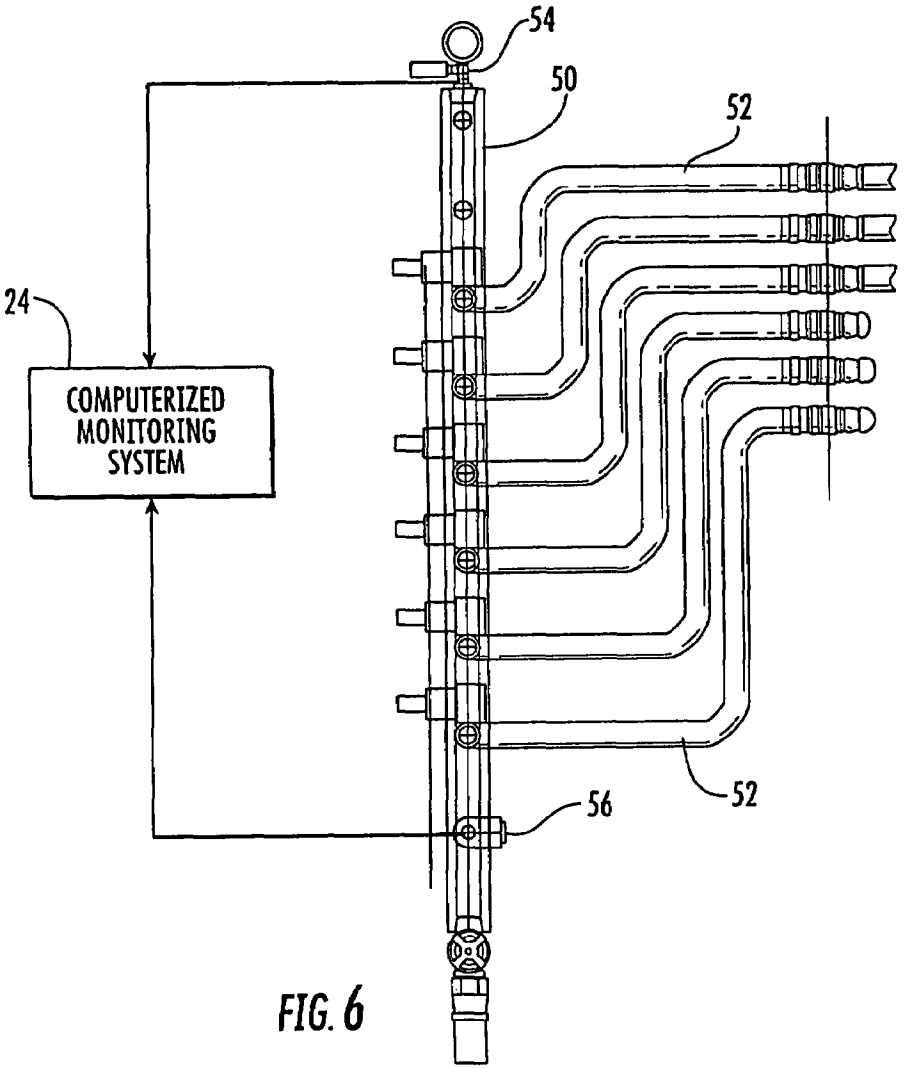
FIG. 6 is a detail view illustrating a portion of the coolant delivery system in the preferred embodiment of the present invention.

The aforesaid high removal rates generated by the grinding wheel 14 are enhanced by the coolant delivery system of the present invention, which is preferably divided into two separate units. As best seen in FIGS. 2 and 5, the first unit utilizes a grinding coolant/lubricant that utilizes a combination of open tube nozzles and directed uniform flow nozzles, such as the primary nozzle 18 and the corner nozzles 20, respectively, to provide a precise coolant/lubricant application at the point of the grind between the grinding wheel 14 and the turbine disk workpiece 26, with low aeration. By virtue of the low aeration of the coolant/lubricant, a more direct flow of the coolant/lubricant can be obtained. The coolant/lubricant flowing through the nozzles 18, 20 is monitored for pressure, speed or flow rate, and temperature to match the lubricity and cooling requirements of each particular grinding process, and the monitoring system 24 in conventional to the extent that it monitors these parameters, and, if desired, generates warning signals when the coolant delivery system is operating outside of defined coolant/lubricant parameters. For example, the monitoring system 24 may include a manifold 50 (see FIG. 6) from which a plurality of supply conduits 52 extend to supply coolant/lubricant to the nozzles 18, 20. The pressure of the coolant/lubricant flowing to and through nozzles 18, 20 is monitored by a conventional pressure sensor 54 that provides information to the computerized monitoring system 24, and the flow rate of the coolant/lubricant can be monitored using a conventional flow sensor 56 that provides information to the monitoring system 24, all as illustrated in FIG. 6. A similar temperature sensor (not shown) may used in or with the manifold 50 to monitor the temperature of the coolant/lubricant and provide information to the computerized monitoring system 24.

Figure 9:
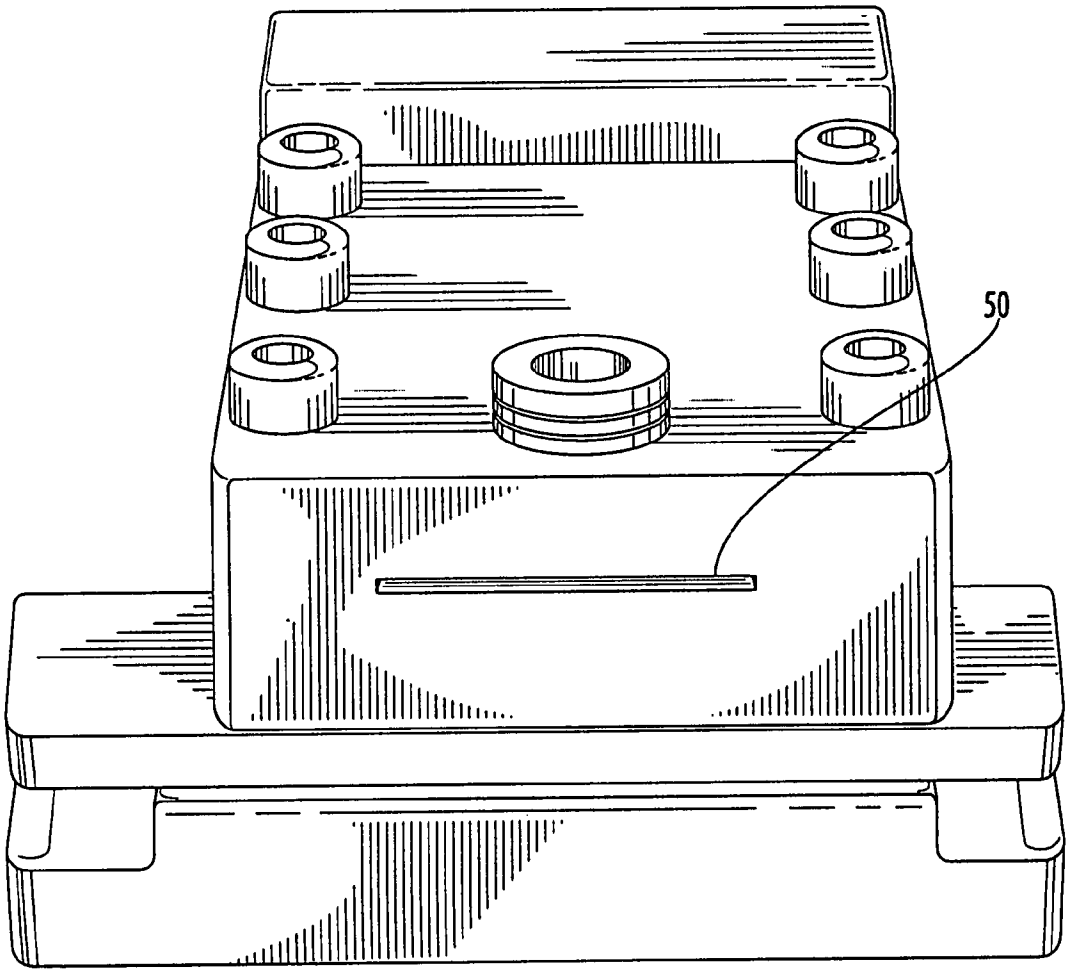
FIG. 9 is a detail view of one of the nozzles that may be used with the present invention.

The second coolant application is a low volume, high pressure application in which the coolant is applied directly to the grinding wheel 14 through the scrubber nozzle 22 to clean the grinding wheel 14. As will be discussed in greater detail below, since the grinding wheel 14 removes relatively large chips of the workpiece 26 during the grinding process of the present invention, the scrubber nozzle 22 enhances the grinding ability of the grinding wheel 14 by removing these large chips and providing a cleaner grinding surface for the grinding wheel 14 when it is applied to the workpiece 26. A sample of one typical embodiment of the nozzles of the present invention is illustrated in FIG. 9, and it includes an elongated slot 50 through which the coolant/lubricant is discharged and directed toward the grinding surface of the grinding wheel 14.

Figure 1:
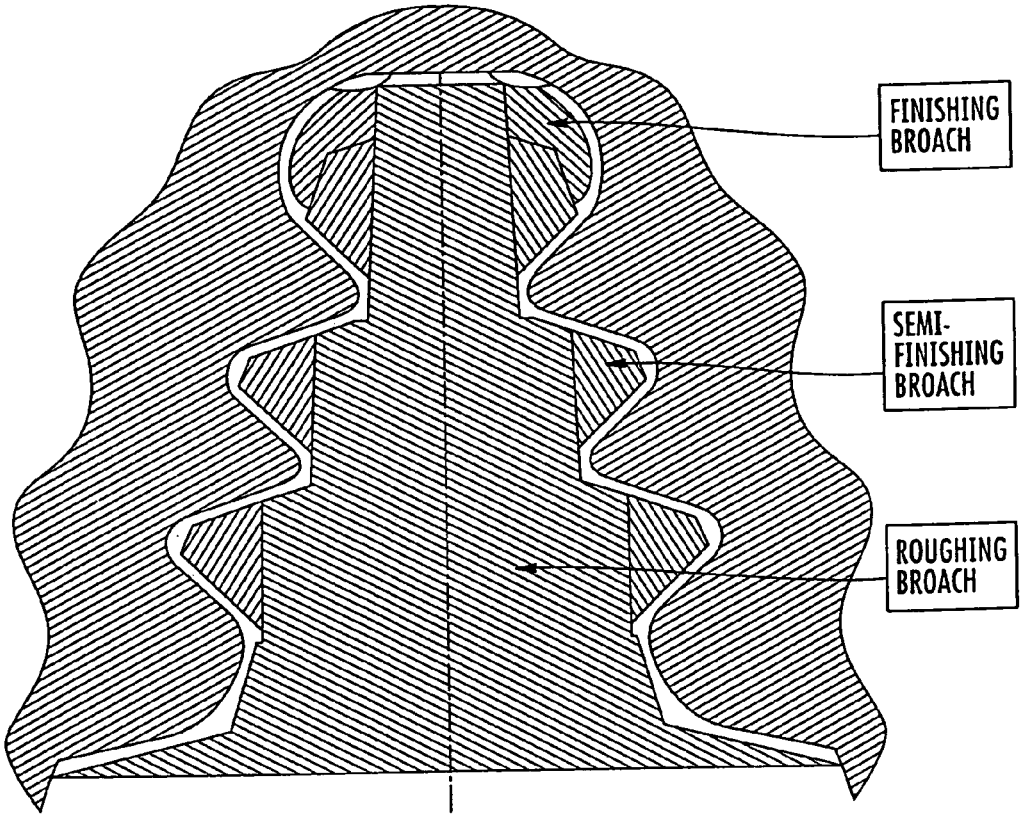
FIG. 1 (PRIOR ART)
FIG. 1 is diagrammatic view illustrating a typical slot formation in a turbine disk formed by a conventional broaching process.

In operation, the turbine disk 26 in which a profile 28 is to be formed is fixed in a jig 30, or other appropriate holding device. The grinding wheel 14 is mounted on the support 10, and the operator of the apparatus 8 controls the movement of the apparatus 8 so that the grinding wheel 14 is moved in a direction toward the turbine disk 26 by the motors 34, and in a vertical direction parallel to the axis of the turbine disk 26 by the motor 40, or at a specified angle relative to the axis. As described in greater detail above, the drive motor 12 drives or rotates the grinding wheel 14 with a desired horsepower and torque, and the apparatus 8 and the housing 10 are moved by the operator to provide the grinding wheel 14 with a predetermined material rate for engaging and grinding the turbine disk 26. At some point in the grinding process, the operator may recognize that the heat generated by the grinding process reaches the burning point resulting from the grinding action of the grinding wheel 14 against the turbine disk 26. In conventional grinding operations, conventional wisdom requires that when the burning point is reached, the material removal rate of the grinding wheel must be reduced, usually by moving the grinding wheel moved away from the workpiece altogether, to reduce the possibility that the burning of the workpiece will cause cracking or other thermal damage to the workpiece at the point of the grinding action. However, is accordance with one of the unique features of the present invention, when the burning point is observed by the operator (e.g. the point at which adverse thermal conditions of the workpiece occur), the operator of the apparatus 8 increases the material removal rate of the grinding wheel 14 by varying the feed rate and/or the rotational speed of the grinding wheel 14 and/or the depth of the cut, and it has been found that the because of the unique combination of the elements of the present invention, when the material removal rate is increased, the burning no longer occurs at the surface of the workpiece where it is being ground away by the grinding wheel 14. Additionally, it has also been found that the aggressive, increased material removal rates permitted by the present invention can be provided with a drive motor 12 that has an increased torque at the optimum speed of the motor as compared to a drive motor that would be used in a similar conventional grinding process. In the operation of the present invention, one unique aspect is the ability of the drive motor 12 to drive the grinding wheel 14 at low speeds while still providing the torque necessary for the aggressive grinding of the grinding wheel 14. For example, in a typical application of the present invention, a conventional drive motor may be used which provides torque in the range of 50-70 lb/ft at speeds less that 3000 rpms. Finally, even though the grinding wheel 14 is applied to the workpiece 26 at an aggressive and increased material removal rate, there is no burning or thermal damage of the workpiece 26 that would create the highly undesirable cracks and thermal damage outside of acceptable limits in the workpiece. Therefore, the present invention has particular application to forming profiles in a turbine disk where the cracks or other thermal damage outside acceptable limits could create dangerous situations in airplanes driven by turbines, as discussed above.

Where the method and apparatus of the present invention are used to form profiles in a turbine disk as illustrated in FIG. 1, one preferred application of the present invention is to perform only the roughing step of the profile as illustrated in FIG. 1, and to then use a conventional broaching machine to finish the profile by performing the finishing steps as illustrated in FIG. 1. It will generally be necessary to make several passes of the grinding wheel 14 through the turbine disk to complete the roughing step but the required number of passes is considerably less that the number of passes that would be required using a conventional grinding wheel and a conventional drive motor for the grinding wheel. Accordingly, the roughing step can be carried out by the present invention in substantially less time and a substantial costs savings as compared with performing the roughing step of the profile using either a conventional grinding system or a broaching machine, and much better results are obtained in terms of avoiding cracking of the parent material of the turbine disk.

The coolant delivery system of the present invention also offers several advantages. By directing the coolant simultaneously to the point where the grinding wheel 14 is in contact with the workpiece 26 and also directly to the grinding surface of the grinding wheel itself excellent lubricating and cooling results are obtained. Moreover, because of the reduced power draw of the drive motor 12, it has been found that less coolant is required as compared with conventional similar grinding processes.

Accordingly, the present invention includes a unique combination of elements that permits a grinding wheel to be used aggressively to grind away material at very high removal rates. This combination includes the utilization of a drive motor 12 that provides high and generally constant torque at low speeds of the motor 12. This motor optimizes the grinding action of the grinding wheel 14 so that it can move through the turbine blade workpiece 26 with a relative slow material removal rate and a relatively high depth of the cut so that the material is separated from the workpiece 26 in relatively large chips as described above. Finally, the coolant application provides precise, uniform and flow with low aeration from the nozzles 18, 20 to maintain consistent cooling and lubricity at the point where the grinding wheel engages the turbine disk workpiece 26, and it is monitored to help in controlling the overall process. The scrubber nozzle 22 effectively cleans residual chips from the grinding surface of the grinding wheel 14 so as to allow it to freely cut the workpiece 26.

As a result, some of the improvements offered by the present invention compared with using only a broaching machine are an increased product throughput with faster material removal from the workpiece, and reducing tooling costs for consumables, specifically a grinding wheel which can be used to replace broaching machine cutter inserts. Also, there is a reduced floor space requirement, as compared with broaching alone, and a reduced inventory for work in progress and cutting consumables. The present invention also offers significant flexibility in that it is possible to quickly change the wheel profile by forming the grinding wheel profile with a conventional integral truing/dressing device, as opposed to re-designing and building new cutting inserts as is required in broaching machines. Finally, the present invention can be carried out without cracking the parent material or inducing other thermal damage.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for cutting profiles in a workpiece without cracking the parent material which includes a grinding wheel having a ceramic grinding surface formed with an optimized grain material and grain spacing to produce large chips that are easily removed from the workpiece; drive means for moving the grinding wheel into contact with the workpiece at a predetermined material removal rate which includes a drive motor for the grinding wheel which is operated at a high torque at the low end of the speed range of the motor; and a coolant delivery system for delivering a coolant/lubricant to the workpiece at the point where the wheel is applied to the workpiece during the grinding operation and for monitoring predetermined parameters of the coolant/lubricant wherein the drive means is operated to move the grinding wheel into contact with the workpiece at a predetermined material rate until the burning point is reached at the surface of the workpiece by the grinding action of the grinding wheel, and the drive means continues moving the grinding wheel into contact with the workpiece at an increased material removal rate when the burning point is reached at the surface of the workpiece by the grinding action of the grinding wheel.

2. Apparatus for cutting profiles in a workpiece as defined in claim 1 wherein the monitored parameters include pressure, speed, and temperature of the coolant.

3. Apparatus for cutting profiles in a workpiece as defined in claim 1 wherein the coolant delivery system includes a first section that provides conduits for directing coolant at the point where the grinding wheel makes contact with the workpiece and a second section that provides conduits for directing coolant directly to the surface of the grinding wheel at a point on the grinding surface spaced from the point where the grinding wheel makes contact with the workpiece.

4. Apparatus for cutting profiles in a workpiece as defined in claim 3 wherein the first section of the coolant delivery system applies a coolant/lubricant to the point of contact at a predetermined pressure, speed and temperature, and wherein the first section of the coolant delivery system monitors the pressure, speed and/or temperature of the coolant/lubricant.

5. Apparatus for cutting profiles in a workpiece as defined in claim 4 wherein the workpiece is a turbine disk.

* * * * *